US006918364B2

(12) United States Patent
Vattaneo et al.

(10) Patent No.: US 6,918,364 B2
(45) Date of Patent: Jul. 19, 2005

(54) MULTICYLINDER ENGINE WITH VALVE VARIABLE ACTUATION, AND AN IMPROVED VALVE BRAKING DEVICE THEREFOR

(75) Inventors: Francesco Vattaneo, Orbassano (IT); Stefano Chiappini, Orbassano (IT); Macor Lorentino, Orbassano (IT); Dante Malatto, Orbassano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 165 days.

(21) Appl. No.: 10/259,527

(22) Filed: Sep. 30, 2002

(65) Prior Publication Data

US 2003/0172890 A1 Sep. 18, 2003

(30) Foreign Application Priority Data

Mar. 15, 2002 (IT) ..... TO2002A0234

(51) Int. Cl.[7] ..... F01L 1/14

(52) U.S. Cl. ..... 123/90.55; 123/90.12; 123/90.44; 123/90.45

(58) Field of Search ..... 123/90.27, 90.31, 123/90.15, 90.16, 90.17, 90.48, 90.49, 90.5, 90.52, 90.55, 90.56, 90.35, 90.44, 90.45, 90.46, 90.11, 90.12, 90.13, 90.22, 90.23, 90.24

(56) References Cited

U.S. PATENT DOCUMENTS

| | | | | |
|---|---|---|---|---|
| 5,309,872 A | * | 5/1994 | Filippi et al. | 123/90.15 |
| 5,485,813 A | * | 1/1996 | Molitor et al. | 123/90.12 |
| 5,577,468 A | * | 11/1996 | Weber | 123/90.12 |
| 5,839,400 A | * | 11/1998 | Vattaneo et al. | 123/90.16 |
| 6,138,621 A | * | 10/2000 | Albanello et al. | 123/90.12 |
| 6,412,457 B1 | * | 7/2002 | Vorih et al. | 123/90.12 |

* cited by examiner

*Primary Examiner*—Thomas Denion
*Assistant Examiner*—Ching Chang
(74) *Attorney, Agent, or Firm*—Sughrue Mion, PLLC

(57) ABSTRACT

Described herein is a multicylinder internal-combustion engine provided with an electronically controlled hydraulic device for controlling variable actuation of the valves of the engine. The final phase of the movement of closing the intake valves is slowed down by a hydraulic braking device of an improved type.

17 Claims, 4 Drawing Sheets

MULTICYLINDER ENGINE WITH VALVE VARIABLE ACTUATION, AND AN IMPROVED VALVE BRAKING DEVICE THEREFOR

BACKGROUND OF THE INVENTION

The present invention relates to multicylinder internal-combustion engines of the type comprising:

at least one intake valve and at least one exhaust valve for each cylinder, each valve being provided with respective elastic return means, which push the valve towards a closed position for controlling respective intake and exhaust pipes; and at least one camshaft, for actuating the intake and exhaust valves of the engine cylinders by means of respective tappets;

in which each intake valve is controlled by the respective tappet against the action of the aforesaid elastic return means by interposition of hydraulic means that include a pressurized fluid chamber;

said pressurized fluid chamber being designed to be connected by means of a solenoid valve to an exhaust channel in order to uncouple the valve from the respective tappet and bring about fast closing of the valve as a result of the respective elastic return means;

electronic control means for controlling each solenoid valve so as to vary the time and the opening stroke of the respective intake valve according to one or more operating parameters of the engine;

in which associated to each intake or exhaust valve is a control piston slidably mounted in a guide bushing;

in which said control piston faces a chamber with variable volume communicating with the pressurized-fluid chamber both via first communication means controlled by a non-return valve, which enables only passage of fluid from the pressurized-fluid chamber to the variable-volume chamber, and via second communication means, which enable passage of fluid between the two chambers in both directions;

said device further comprising hydraulic-braking means designed to cause a restriction of said second communication means in the final phase of closing of the valve of the engine.

An engine of the type specified above is, for example, described and illustrated in the European patent application EP-A-0 803 642 in the name of the present applicant.

SUMMARY OF THE INVENTION

The purpose of the present invention is to further improve the device described above.

With a view to achieving the above purpose, the subject of the present invention is a multicylinder engine having all the aforementioned characteristics and further comprising the characteristics that form the subject of the characterizing part of the annexed Claim 1.

Further characteristics and advantages of the invention are specified in the sub-claims.

BRIEF DESCRIPTION OF THE DRAWINGS

The present invention will now be described, with reference to the attached drawings, which are provided purely by way of non-limiting example, and in which.

DETAILED DESCRIPTION OF THE INVENTION

Figure 1:
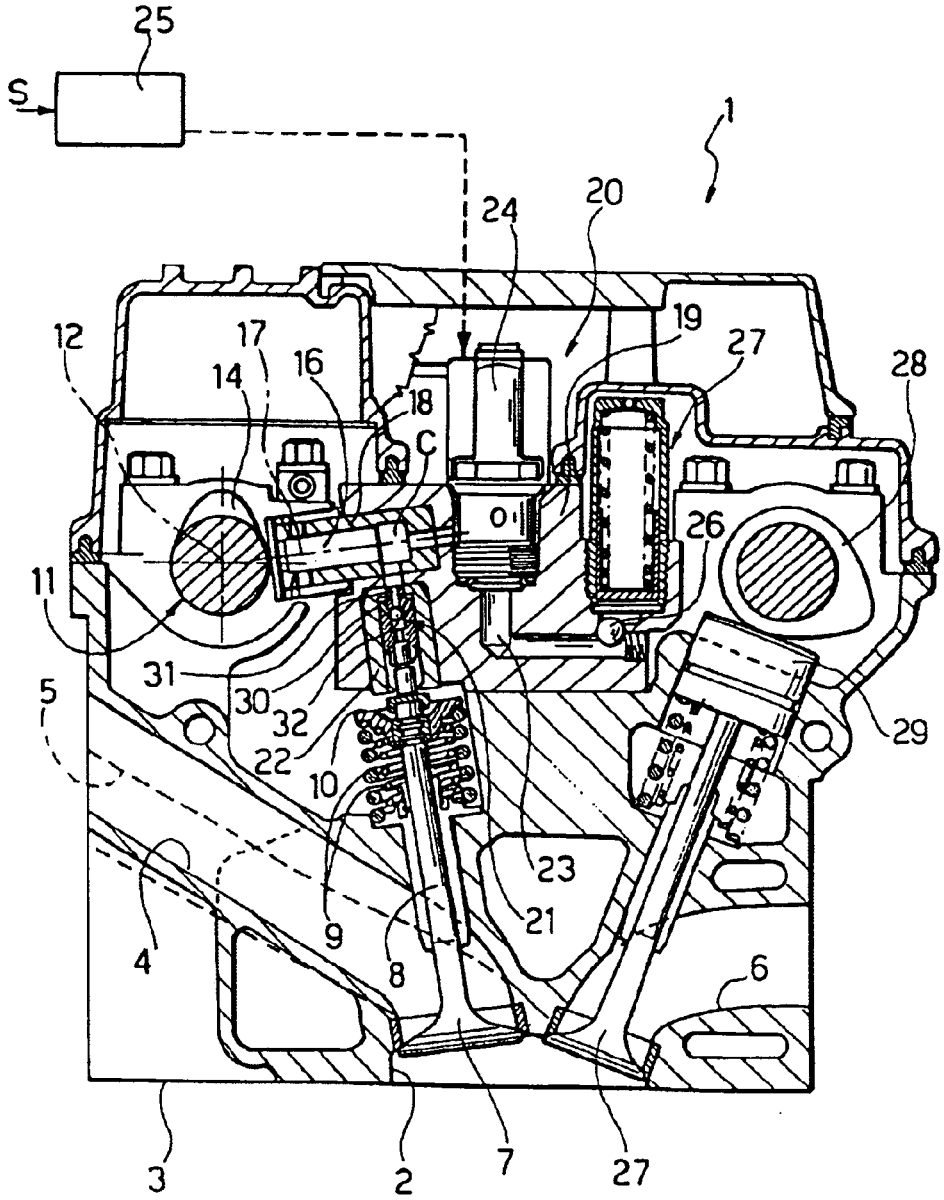
FIG. 1 PRIOR ART
FIG. 1 is a cross-sectional view of an engine according to the known art, of the type described in the European patent application EP-A-0 803 642 in the name of the present applicant.

With reference to FIG. 1, the internal-combustion engine described in the previously mentioned European patent application EP-A-0 803 642 in the name of the present applicant is a multicylinder engine, for example, a four-cylinder in-line engine comprising a cylinder head 1. The cylinder head 1 comprises, for each cylinder, a cavity 2 formed in the base surface 3 of the head 1, which defines the combustion chamber, and into which there give out two intake pipes 4, 5 and two exhaust pipes 6. Communication of the intake pipes 4, 5 with the combustion chamber 2 is controlled by two intake valves 7 of the traditional poppet or mushroom type, each comprising a stem 8 slidably mounted in the body of the cylinder head 1. Each valve 7 is recalled to the closing position by springs 9 set between an internal surface of the cylinder head 1 and an end cup or bucket 10 of the valve. Opening of the intake valve 7 is controlled, in the way that will be described hereinafter, by a camshaft 11, which is mounted so that it can turn about an axis 12 within supports of the cylinder head 1 and which comprises a plurality of cams 14 for actuation of the valves.

Each cam 14 for controlling an intake valve 7 co-operates with the cup 15 of a tappet 16 slidably mounted along an axis 17, which, in the case of the example illustrated in the above-mentioned prior document, was set in a direction at substantially 90° with respect to the axis of the valve 7. The tappet 16 is slidably mounted within a bushing 18 carried by a body 19 of a pre-assembled unit 20, which incorporates all the electrical and hydraulic devices associated to operation of the intake valves, according to what is described in detail hereinafter. The tappet 16 is able to transmit a thrust to the stem 8 of the valve 7 so as to cause opening of the latter against the action of the elastic means 9 by fluids under pressure (typically oil coming from the lubricating circuit of the engine), which is present in a chamber C, and a piston 21 slidably mounted in a cylindrical body consisting of a bushing 22, which is also carried by the body 19 of the subassembly 20. Once again in the known solution illustrated in FIG. 1, the pressurized-fluid chamber C, associated to each intake valve 7, can be set in communication with an outlet channel 23 by means of a solenoid valve 24. The solenoid valve 24, which may be of any known type suitable for the function illustrated herein, is controlled by electronic control means, designated as a whole by 25, according to the signals S that indicate operating parameters of the engine, such as the position of the accelerator and the engine r.p.m. When the solenoid valve 24 is opened, the chamber C enters into communication with the channel 23, so that the pressurized fluid present in the chamber C flows into the channel 23 and there is obtained a decoupling of the tappet 16 from the respective intake valve 7, which then rapidly returns to its closing position under the action of the return spring 9. By controlling communication between the chamber C and the outlet channel 23, it is therefore possible to vary the time and stroke of opening of each intake valve 7 as desired.

The outlet channels 23 of the various solenoid valves 24 all give out into one and the same longitudinal channel 26, which communicates with four pressure accumulators 27, only one of which is visible in FIG. 1. All the tappets 16 with the associated bushings 18, the pistons 21 with the associated bushings 22, the solenoid valves 24 and the corresponding channels 23, 26 are carried by and made out of the aforesaid body 19 of the pre-assembled unit 20, to the advantage of speed and ease of assembly of the engine.

The exhaust valves 27 associated to each cylinder are controlled, in the embodiment illustrated in FIG. 1, in a traditional way, by a camshaft 28 by means of respective tappets 29, even though, in principle, there is not ruled out, both in the case of the prior document cited above and in the case of the present invention, an application of the system for variable actuation of the valves also under control of the exhaust valves.

Once again with reference to FIG. 1, the variable-volume chamber defined inside the bushing 22 of the piston 21, which, in the case of FIG. 1, is illustrated in its minimum-volume condition, the piston 21 being in its top end-of-stroke position, communicates with the pressurized-fluid chamber C by means of an opening 30 made in an end wall of the bushing 22. The said opening 30 is engaged by an end nose 31 of the piston 21, so as to provide a hydraulic braking of the movement of the valve 7 during closing, when the valve 7 is close to the closed position, in so far as the oil present in the variable-volume chamber is forced to flow into the pressurized-fluid chamber C passing through the clearance existing between the end nose 31 and the wall of the opening 30 engaged thereby. In addition to the communication constituted by the opening 30, the pressurized-fluid chamber C and the variable-volume chamber of the piston 21 communicate with one another through internal passages made in the body of the piston 21 and controlled by a non-return valve 32, which enables only passage of fluid from the pressurized-fluid chamber C to the variable-volume chamber of the piston.

During normal operation of the known engine illustrated in FIG. 1, when the solenoid valve 24 shuts off communication between the pressurized-fluid chamber C and the exhaust channel 23, the oil present in said chamber transmits the movement of the tappet 16 imparted by the cam 14 to the piston 21, which controls opening of the valve 7. In the initial phase of movement of opening of the valve, the fluid coming from the chamber C reaches the variable-volume chamber of the piston 21, passing through an axial hole made in the nose 30, the non-return valve 32 and further passages that set the internal cavity of the piston 21, which has a tubular conformation, in communication with the variable-volume chamber. After a first displacement of the piston 21, the nose 31 comes out of the opening 30, so that the fluid coming from the chamber C can pass directly into the variable-volume chamber through the opening 30, which is now free. In the reverse movement of closing of the valve, as has already been said, during the final phase, the nose 31 enters into the opening 30, causing hydraulic braking of the valve, so as to prevent any impact of the body of the valve against its seat.

Figure 2:
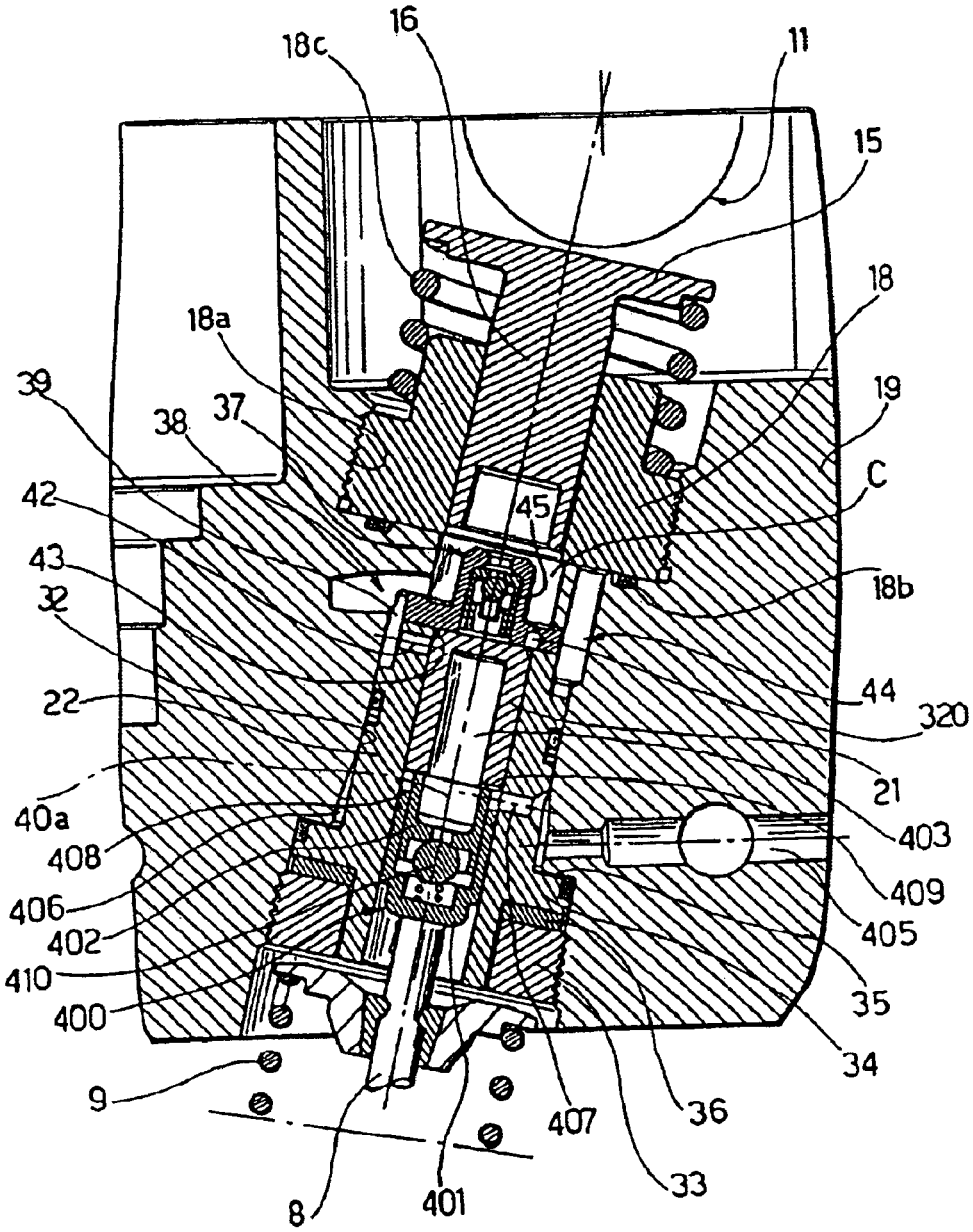
FIG. 2 is a cross-sectional view at an enlarged scale of the tappet of an intake valve of an engine according to the present invention.

FIG. 2 illustrates how the device described above can be modified according to a possible embodiment of the present invention.

In FIG. 2, parts that are in common with those of FIG. 1 are designated using the same reference numbers.

A first evident difference of the device illustrated in FIG. 2, as compared to the one illustrated in FIG. 1, lies in the fact that, in the case of FIG. 2, the tappet 16, the piston 21, and the stem 8 of the valve are aligned together according to an axis 40*a*. This difference does not in any case fall within the scope of the invention since it is already known to the prior art. Likewise, the invention would apply also to the case in which the axes of the tappet 16 and of the stem 8 formed an angle with respect to one another.

As in the case of the known solution, the tappet 16, with the corresponding cup 15 that co-operates with the cam of the camshaft 11 is slidably mounted in a bushing 18. In the case of FIG. 2, the bushing 18 is screwed within a threaded cylindrical seat 18*a* made in the metal body 19 of the pre-assembled unit 20. An O-ring 18*b* is set between the bottom wall of the bushing 18 and the bottom wall of the seat 18*a*. A spring 18*c* recalls the cup 15 into contact with the cam of the camshaft 11.

As in the case of FIG. 1, also in the case of FIG. 2 the piston 21 is slidably mounted in a bushing 22, which is received in a cylindrical cavity 32 made in the metal body 19, with interposition of O-rings. The bushing 22 is withheld in the mounted condition by a threaded ring nut 33, which is screwed into a threaded end portion of the cavity 32 and which presses an annular flange 34 of the body of the piston 22 against a contrast surface 35 of the cavity 32. Set between the locking ring nut 33 and the flange 34 is a Belleville washer 36 for the purpose of guaranteeing a controlled axial load that will compensate any differential thermal expansion between the different materials making up the body 19 and the bushing 22.

The main difference between the solution illustrated in FIG. 2 and the known solution of FIG. 1 lies in the fact that, in this case, the non-return valve 45, which enables passage of the fluid under pressure from the chamber C to the chamber of the piston 21 is not carried by the piston 21 but rather by a separate element 37 that is fixed with respect to the body 19 and closes, at the top, the cavity of the bushing 22, within which the piston 21 is slidably mounted. In addition, the piston 21 does not present the complicated conformation of FIG. 1, with the end nose 31, but rather has the form of a simple cylindrical element shaped like a cup, with a bottom wall facing the variable-volume chamber which receives fluid under pressure from the chamber C by means of the non-return valve 45.

Figure 3:
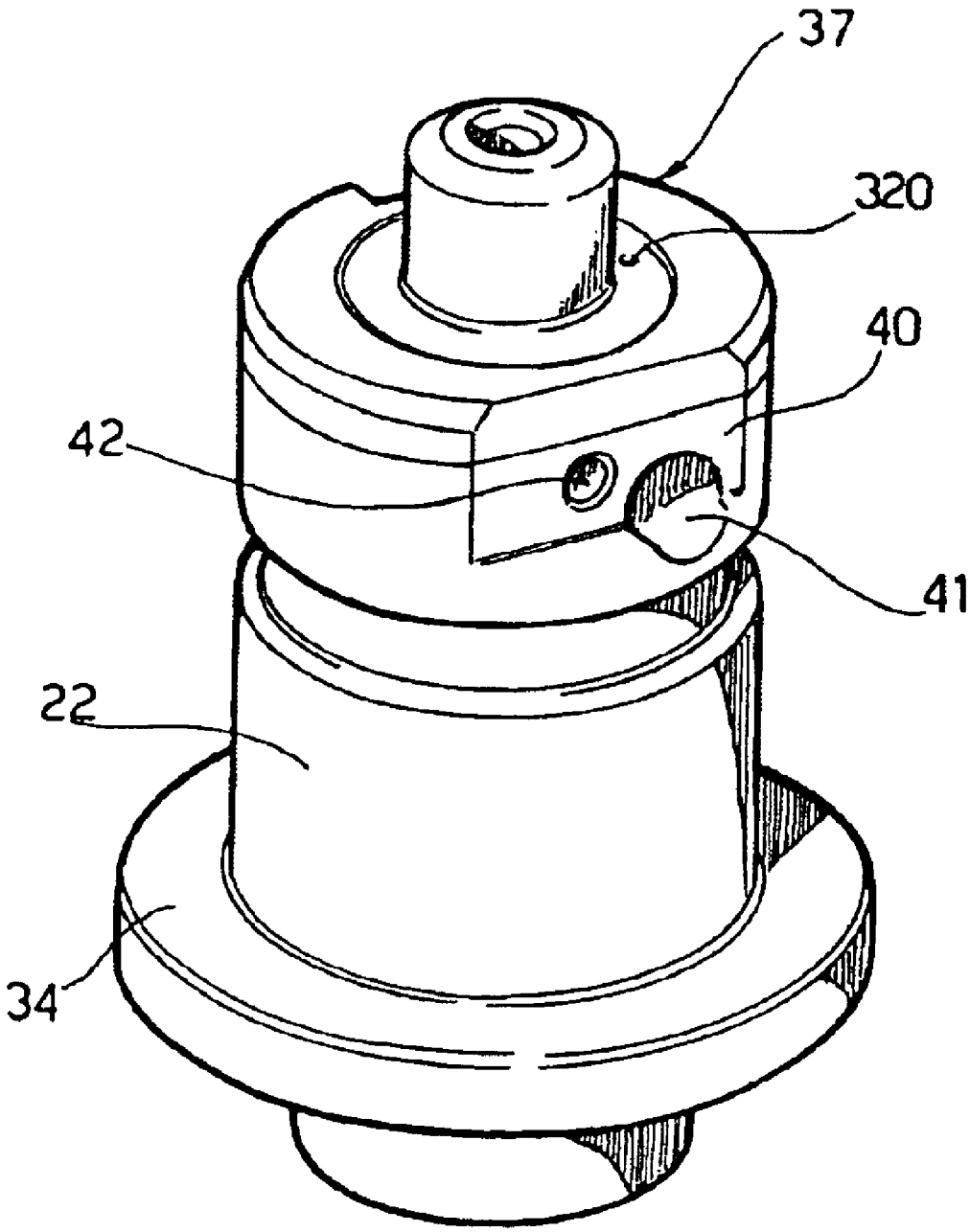
FIG. 3 is a perspective view of a detail of FIG. 2.

The element 37 is represented by an annular plate which is fixed in position between a contrast surface of the body 19 and the end surface of the bushing 22 following upon tightening of the locking ring nut 33. The annular plate has a cylindrical central projection which acts as a casing for the non-return valve 32 and which has a top central hole for passage of the fluid. Also in the case of FIG. 2, the chamber C and the variable-volume chamber delimited by the piston 21 communicate with one another, apart from via the non-return valve 45, also via a further passage consisting of a lateral cavity 38 made in the body 19, a peripheral cavity 39 defined by a flattened area 40 (see FIG. 3) of the outer surface of the bushing 22 as well as by an opening 41 of larger dimensions and by a hole 42 of smaller dimensions (see FIG. 3), which are made radially in the wall of the bushing 22. The holes 41, 42 are shaped and arranged with respect to one another in order to provide the operation with hydraulic brake in the final phase of closing of the valve, in so far as, when the piston 21 has obstructed the opening 41, the hole 42, which shuts off a peripheral end gap defined by an end circumferential groove of the piston 21 remains free. In order to guarantee that the openings 41, 42 will shut off the fixed passage 38 properly, the bushing 34 must be mounted in a precise angular position, which is guaranteed by an axial pin 44. This solution is preferred as compared to the arrangement of a circumferential gap on the outer surface of the bushing 22, in that the latter would involve an increase in the volumes of oil involved, with consequent drawbacks in terms of operation. There is then provided a calibrated hole 320 in the element 37, which sets the annular chamber defined by the gap 43 in communication with the chamber C. The said hole 320 guarantees proper operation at low temperature, when the fluid (engine-lubricating oil) is very viscous.

In operation, when the valve must be opened, oil under pressure, pushed by the tappet 16, flows from the chamber C to the chamber of the piston 21, by way of the non-return valve 45. As soon as the piston 21 has moved away from its top end-of-stroke position, the oil can then flow directly into the variable-volume chamber through the passage 38 and the openings 41, 42, bypassing the non-return valve 45. In the movement of return, when the valve is close to its closed position, the piston 21 first shuts off the opening 41 and then the opening 42, so bringing about hydraulic braking. A calibrated hole may also be provided in the wall of the element 37 for reducing the braking effect at low temperatures when the viscosity of the oil would lead to an excessive slowing-down of the movement of the valve.

As may be seen, the main difference as compared to the known solution illustrated in FIG. 1 lies in the fact that the operations of fabrication of the piston 21 are far simpler since the piston 21 has a conformation much less complicated than the one envisaged in the known art. The solution according to the invention also enables a reduction in the volume of oil in the chamber associated to the piston 21, which makes it possible to obtain a regular movement of closing of the valve, without any hydraulic rebound, a reduction in the time required for closing, a regular operation of the hydraulic tappet without any pumping, a reduction in the pulse-like force in the springs of the engine valves, and a reduction in hydraulic noise.

A further characteristic of the invention lies in the prearrangement of a hydraulic tappet 400 between the piston 21 and the stem 8 of the valve. The tappet 400 comprises two concentric slidable bushings 401, 402. The inner bushing 402 defines, with the internal cavity of the piston 21, a chamber 403, which is supplied with fluid under pressure by means of passages 405, 406 in the body 19, a hole 407 in the bushing 22, and passages 408, 409 in the bushing 402 and in the piston 21.

A non-return valve 410 controls a central hole in a front wall carried by the bushing 402.

Figure 4:
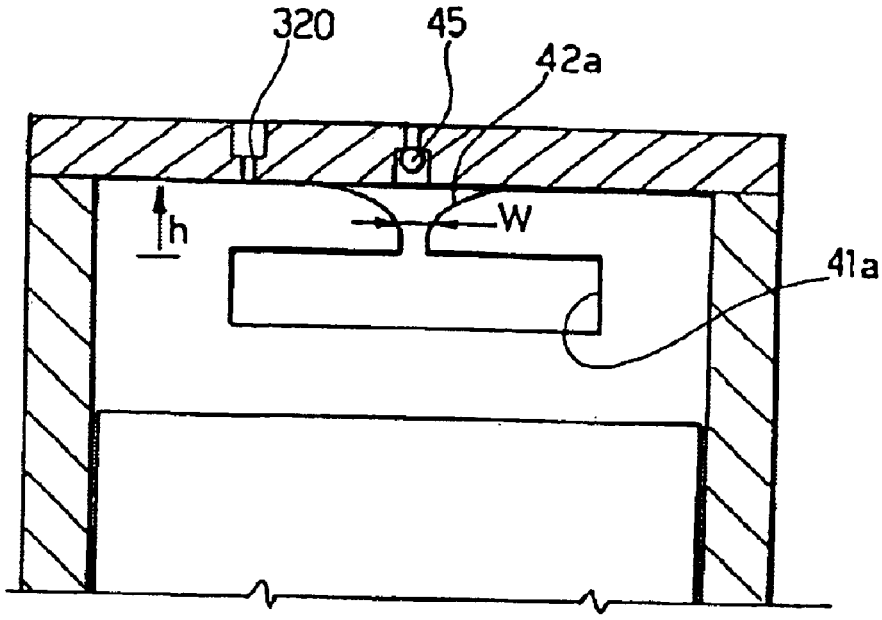
FIGS. 4 and 5 are a schematic cross-sectional view and a partial perspective view of a variant of the detail of FIG. 3.
Figure 5:
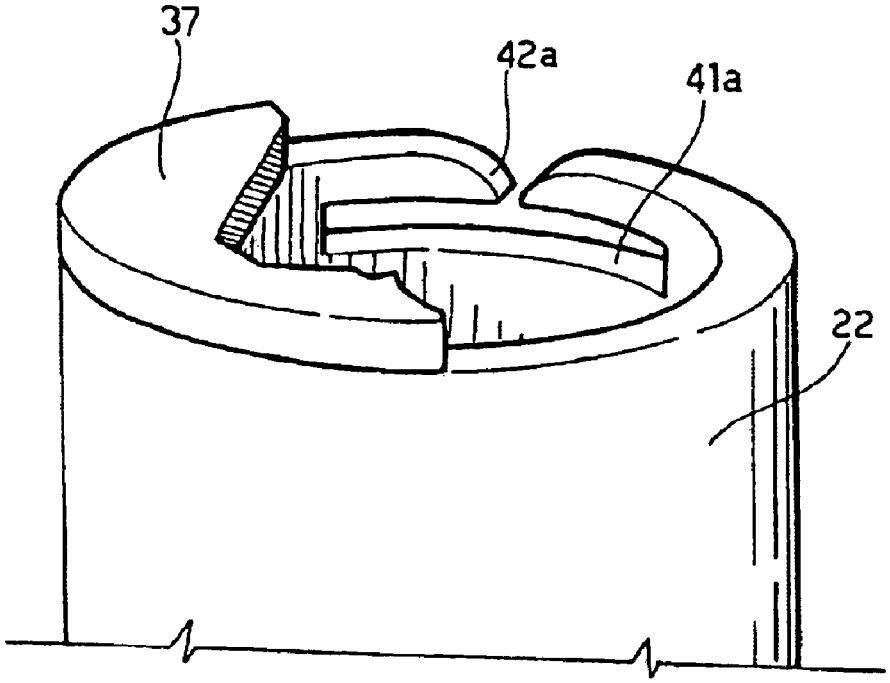

FIGS. 4 and 5 illustrate a variant in which the two openings 41, 42 are replaced, respectively, by a circumferential slit 41*a* and a flared slit 42*a*. The profile of the flared portion 42*a* is calculated to guarantee a constant acceleration in the hydraulic-braking phase in order to minimize both the braking stroke and the duration of braking. In this way, a variation in the area of leakage of the oil is obtained that is proportional to the rate of the piston 21. FIG. 4 is a schematic illustration of the non-return valve 45 and the calibrated hole 320 for braking at low temperature.

As may be seen, the width W (see FIG. 4) of the leakage opening 42*a* varies progressively in the direction h of its height. In order to guarantee the condition referred to above of a constant acceleration, the following expression of W is obtained:

$$W(h)=B\times h^{1/2}$$

where B is a constant of braking which depends upon the area A of the piston 21, the oil density, the flow coefficient c of the area of constriction, the moving mass m, the loading F of the spring and the braking acceleration a according to the following relation:

$$B=A(rA)^{1/2}/(2c(F/a+m)^{1/2})$$

Studies and experiments carried out by the applicant have demonstrated that the aforesaid profile for the constriction opening 42*a* effectively enables minimization of the braking force and braking duration.

Of course, without prejudice to the principle of the invention, the details of construction and the embodiments may vary widely with respect to what is described and illustrated purely by way of example, without thereby departing from the scope of the present invention.

The passage 320, if present, may be replaced by a slit made radially on the element 37.

What is claimed is:

1. A multicylinder internal-combustion engine, comprising:

at least one intake valve and at least one exhaust valve for each cylinder, each valve being provided with respective elastic return means, which push the valve towards a closed position for controlling respective intake pipes and exhaust pipe; and at least one camshaft, for actuating the intake valves and exhaust valves of the engine cylinders by means of respective tappets;

in which each intake valve is controlled by the respective tappet against the action of the aforesaid elastic return means by interposition of hydraulic means that include a pressurized fluid chamber;

said pressurized fluid chamber being designed to be connected by means of a solenoid valve to an exhaust channel in order to uncouple the valve from the respective tappet and bring about fast closing of the valve as a result of the respective elastic return means;

electronic control means for controlling each solenoid valve so as to vary the time and the opening stroke of the respective intake valve according to one or more operating parameters of the engine;

in which associated to each intake or exhaust valve is a control piston slidably mounted in a guide bushing;

in which said control piston faces a chamber with variable volume communicating with the pressurized-fluid chamber both via first communication means controlled by a non-return valve, which enables only passage of fluid from the pressurized-fluid chamber to the variable-volume chamber, and via second communication means, which enable passage of fluid between the two chambers in both directions;

wherein said second communication means include hydraulic-braking means designed to cause a restriction of said second communication means in the final phase of closing of the valve of the engine;

wherein set between the control piston and the stem of the valve is a hydraulic tappet comprising:

a first outer bushing slidably mounted within said guide bushing and having an end wall in contact with a cooperating end of the stem of the engine valve, a second inner bushing slidably mounted within said first outer bushing and having one end in contact with a cooperating end of said control piston, a first chamber defined between said second bushing and said control piston, which is in communication with a passage formed within the fixed body, for feeding fluid under pressure to said first chamber;

a second chamber defined between said first bushing and said second bushing, and a non-return valve controlling a passage in a wall of said second bushing for enabling passage of fluid only from said first chamber of the tappet to said second chamber of the tappet.

2. The engine according to claim 1, wherein the control piston has a cylindrical cup-like conformation with a bottom wall facing said variable-volume chamber and an end circumferential gap, which defines an annular chamber.

3. The engine according to claim 1, wherein the control piston has a cylindrical cup-like conformation with a bottom wall facing said variable-volume chamber and an end circumferential gap, which defines an annular chamber.

4. The engine according to claim 3, wherein said radial passage comprise two holes of different diameter shaped and arranged in such a way that, in the final phase of closing of the valve, the only communication between the variable-volume chamber and the pressurized chamber is constituted by the aforesaid hole of smaller diameter.

5. The engine according to claim 3, wherein said further radial passages comprise a circumferential slit and a flared slit made in the body of the bushing and designed to be shut off in succession by the control piston in the final phase of closing of the valve.

6. The engine according to claim 5, wherein the aforesaid slit has a width that varies progressively in the direction of the axis of the guide bushing according to the law $W(h)=B\times H^{1/2}$, where W is the width, h is the axial direction, and B is a constant that depends upon a set of parameters.

7. The engine according to claim 1, wherein the guide bushing is fixed in a cylindrical seat, made in the body of the head, by a threaded ring nut, with interposition of a Belleville washer with the purpose of compensating the different thermal expansion due to the different materials making up the guide bushing and the body in which the guide bushing is received.

8. The engine according to claim 2, wherein the annular chamber defined by the aforesaid end peripheral gap of the control piston communicates with the pressurized-fluid chamber directly via a calibrated hole or a radial slit in the body of the bushing in order to guarantee proper operation of the device also at low temperatures when the viscosity of the fluid is relatively high.

9. A multicylinder internal-combustion engine, comprising:

at least one intake valve and at least one exhaust valve for each cylinder, each valve being provided with respective elastic return means, which push the valve towards a closed position for controlling respective intake pipes and exhaust pipe; and at least one camshaft, for actuating the intake valves and exhaust valves of the engine cylinders by means of respective tappets;

in which each intake valve is controlled by the respective tappet against the action of the aforesaid elastic return means by interposition of hydraulic means that include a pressurized fluid chamber;

said pressurized fluid chamber being designed to be connected by means of a solenoid valve to an exhaust channel in order to uncouple the valve from the respective tappet and bring about fast closing of the valve as a result of the respective elastic return means;

electronic control means for controlling each solenoid valve so as to vary the time and the opening stroke of the respective intake valve according to one or more operating parameters of the engine;

in which associated to each intake or exhaust valve is a control piston slidably mounted in a guide bushing;

in which said control piston faces a chamber with variable volume communicating with the pressurized-fluid chamber both via first communication means controlled by a non-return valve, which enables only passage of fluid from the pressurized-fluid chamber to the variable-volume chamber, and via second communication means, which enable passage of fluid between the two chambers in both directions;

wherein said second communication means include hydraulic-braking means designed to cause a restriction of said second communication means in the final phase of closing of the valve of the engine;

wherein the non-return valve which controls said first communication means is carried by an element that is separated from the aforesaid control piston and is fixed with respect to the guide bushing of the piston.

10. The engine according to claim 1, wherein the control piston has a cylindrical cup-like conformation with the bottom wall facing said variable-volume chamber and an end circumferential gap, which defines an annular chamber.

11. The engine according to claim 1, wherein said second communication means include one or more passages formed in a wall of said guide bushing.

12. The engine according to claim 3, wherein said radial passages comprise two holes of different diameter shaped and arranged in such a way that, in the final phase of closing of the valve, the only communication between the variable-volume chamber and the pressurized chamber is constituted by the aforesaid hole of smaller diameter.

13. The engine according to claim 3, wherein said further radial passages comprise a circumferential slit and a flared slit made in the body of the bushing and designed to be shut off in succession by the control piston in the final phase of closing of the valve.

14. The engine according to claim 5, wherein the aforesaid slit has a width that varies progressively in the direction of the axis of the guide bushing according to the law $W(h)=B\times h^{1/2}$, where w is the width, h is the axial direction, and B is a constant that depends upon a set of parameters.

15. The engine according to claim 1, wherein the guide bushing is fixed in a cylindrical seat, made in the body of the head, by a threaded ring nut, with interposition of a Belleville washer with the purpose of compensating the different thermal expansion due to the different materials making up the guide bushing and the body in which the guide bushing is received.

16. The engine according to claim 1, wherein set between said control piston and the stem of the valve is a hydraulic tappet.

17. The engine according to claim 2, wherein the annular chamber defined by the aforesaid end peripheral gap of the control piston communicates with the pressurized-fluid chamber directly via a calibrated hole or a radial slit in the body of the bushing in order to guarantee proper operation of the device also at low temperatures when the viscosity of the fluid is relatively high.

* * * * *